US007008762B2

(12) United States Patent
Zhang et al.

(10) Patent No.: US 7,008,762 B2
(45) Date of Patent: Mar. 7, 2006

(54) ELECTRICAL CONNECTOR ASSEMBLY HAVING GROUNDING FUNCTION

(75) Inventors: Daokuan Zhang, Kunsan (CN); Qin Wan, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/982,520

(22) Filed: Nov. 5, 2004

(65) Prior Publication Data

US 2005/0106939 A1 May 19, 2005

(30) Foreign Application Priority Data

Nov. 14, 2003 (TW) ..... 92220203 U

(51) Int. Cl.
*H01R 13/60* (2006.01)
*H01R 13/66* (2006.01)

(52) U.S. Cl. ..... 430/541.5; 439/607

(58) Field of Classification Search ..... 439/541.5, 439/607, 609, 79, 76.1, 620
See application file for complete search history.

(56) References Cited

U.S. PATENT DOCUMENTS 6,183,292 B1 2/2001 Chen et al.
6,755,685 B1 * 6/2004 Espenshade ..... 439/541.5

* cited by examiner

*Primary Examiner*—Javaid H. Nasri
(74) *Attorney, Agent, or Firm*—Wei Te Chung

(57) ABSTRACT

An electrical connector assembly (100) mounted on a printed circuit board includes an insulative housing (1) defining an upper space (10) and a lower space (11), a contact module (2) received in the upper space, a stacked USB (3) received in the lower space, a daughter circuit board (5) and a transform module (6). The contact module includes a plurality of conductive terminals (22) for soldering to the daughter circuit board. The stacked USB includes a dielectric body (31) and a metal frame for shielding the body. The metal frame includes a grounding finger (33) for electrically connecting the daughter circuit board, thereby forming an electrical connection between the electrical connector assembly and the printed circuit board.

15 Claims, 4 Drawing Sheets

ELECTRICAL CONNECTOR ASSEMBLY HAVING GROUNDING FUNCTION

BACKGROUND OF THE INVENTION

1. Field of the Invention

This invention generally relates to an electrical connector assembly and more particular, to an electrical connector assembly exhibiting excellent grounding capability.

2. Description of the Prior Art

Referring to U.S. Pat. No. 6,183,292 discloses an electrical connector assembly. The electrical connector assembly includes an insulative housing, a RJ45 connector, a stacked Universal Serial Bus (USB) connector, a daughter circuit board and a magnetic module mounted on the daughter circuit board. The daughter circuit board includes a plurality of circuit traces. The RJ45 connector is electrically connected with the circuit traces of the daughter circuit board. The daughter circuit board includes a grounding finger mounted thereon, the USB connector includes a metal shell engaging with the grounding finger, thereby forming an electrical connection between the daughter circuit board and the USB connector. However, the grounding finger needs to be manufactured separately and be soldered to the daughter circuit board. Therefore, the working procedure of the electrical connector assembly is relatively excessive and the cost is relatively high.

Hence, an improved electrical connector assembly is desired to overcome the foregoing shortcomings.

BRIEF SUMMARY OF THE INVENTION

It is an object of the present invention to provide an electrical connector assembly which has a simple structure and can be easily manufactured.

In order to attain the object above, an electrical connector assembly mounted on a printed circuit board includes an insulative housing defining an upper space and a lower space, a contact module received in the upper space, a stacked USB received in the lower space, a daughter circuit board and a transform module. The contact module includes a plurality of conductive terminals for soldering to the daughter circuit board. The stacked USB includes a dielectric body and a metal frame for shielding the body. The metal frame includes a grounding finger for electrically connecting the daughter circuit board, thereby forming an electrical connection between the electrical connector assembly and the printed circuit board.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
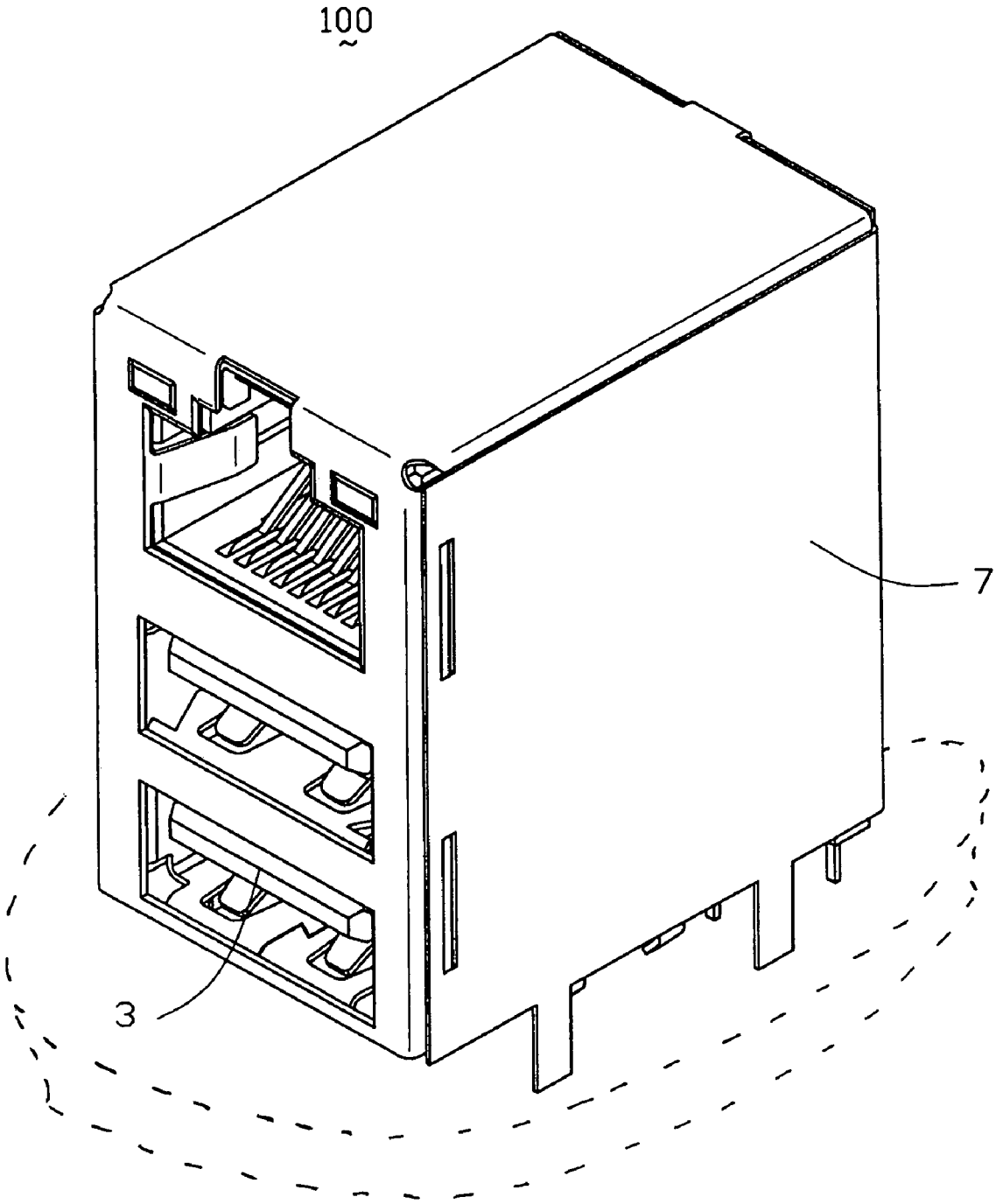
FIG. 1 is a perspective view of an electrical connector assembly according to the present invention.
Figure 2:
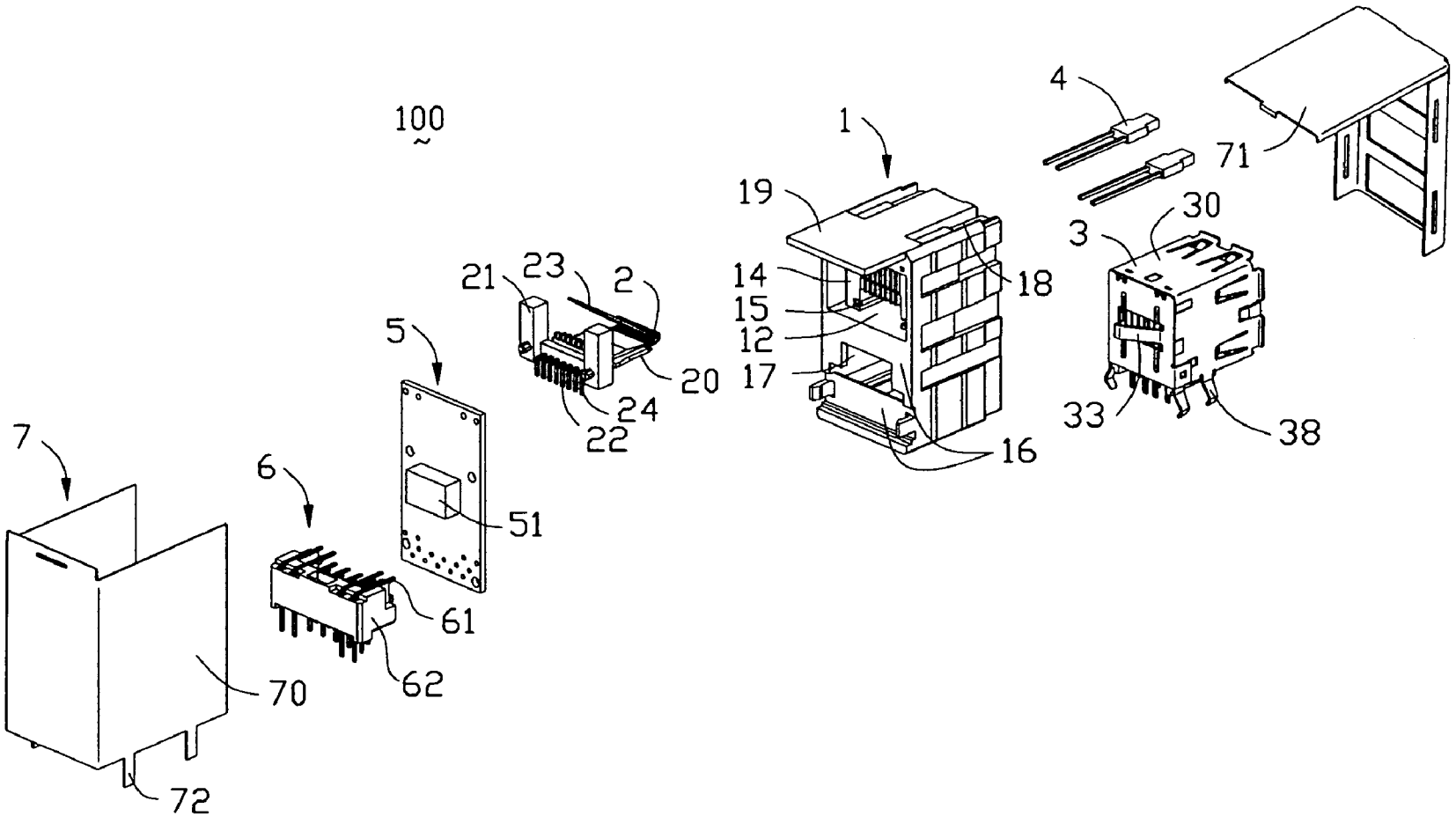
FIG. 2 is an exploded view of the electrical connector.
Figure 3:
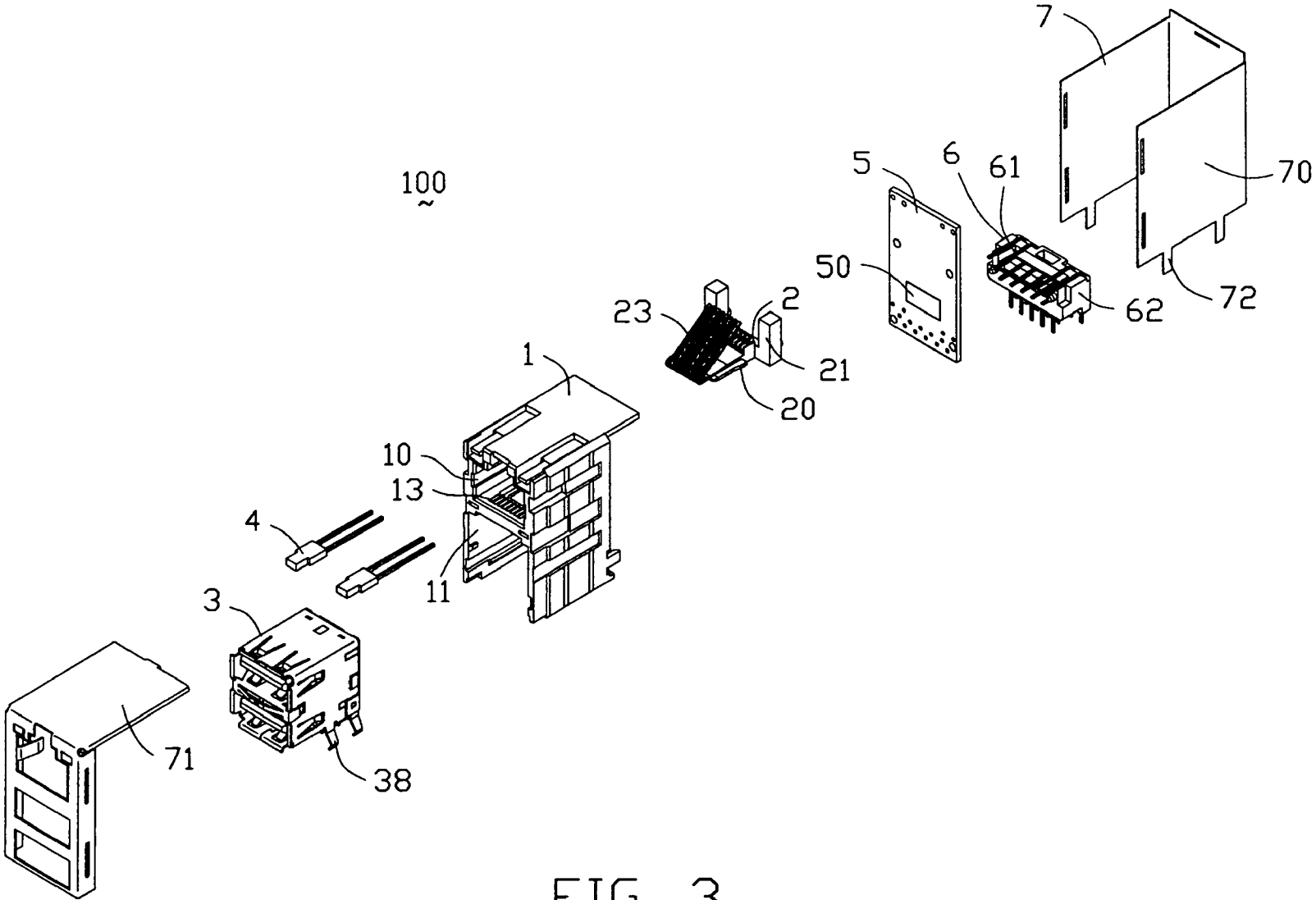
FIG. 3 is another exploded view of the electrical connector.

Referring to FIGS. 2–3, an electrical connector assembly 100 in accordance with the present invention is mounted on a printed circuit board as shown in the dashed lines in FIG. 1, and comprises an insulative housing 1, a contact module 2, a stacked Universal Serial Bus (USB) connector 3, two light emitting diodes (LEDs) 4, a daughter circuit board 5, a transform module 6 and a outer shell 7 for shielding the housing 1.

The insulative housing 1 defines an upper space 10 and a lower space 11 separated by a horizontal partition 12 for receiving the contact module 2 and the stacked USB connector 3, respectively. The upper space 10 includes a pair of projecting portions 14 inwardly extending from opposite side walls thereof. Each projecting portion 14 defines a slot 15 at a bottom portion thereof. The lower space 11 includes a clapboard 16 positioned in a rear portion thereof perpendicular to the horizontal partition 12. A through hole 17 is defined in a middle portion of the clapboard. The insulative housing 1 defines a pair of grooves 18 on a top wall thereof for accommodating the LEDs 4. A tail portion 19 rearward projects from a rear portion of the top wall for supporting the out shell 6.

The contact module 2 includes a horizontal portion 20, a pair of posts 21 upwardly extending from opposite sides of a rear portion of the horizontal portion 20 and a plurality of conductive terminals 22 fixed in the horizontal portion 20. Each conductive terminal 22 includes a contacting portion 23 for engaging with a mating connector (not shown) and a soldering portion 24 for soldering with the daughter circuit board 5.

Figure 4:
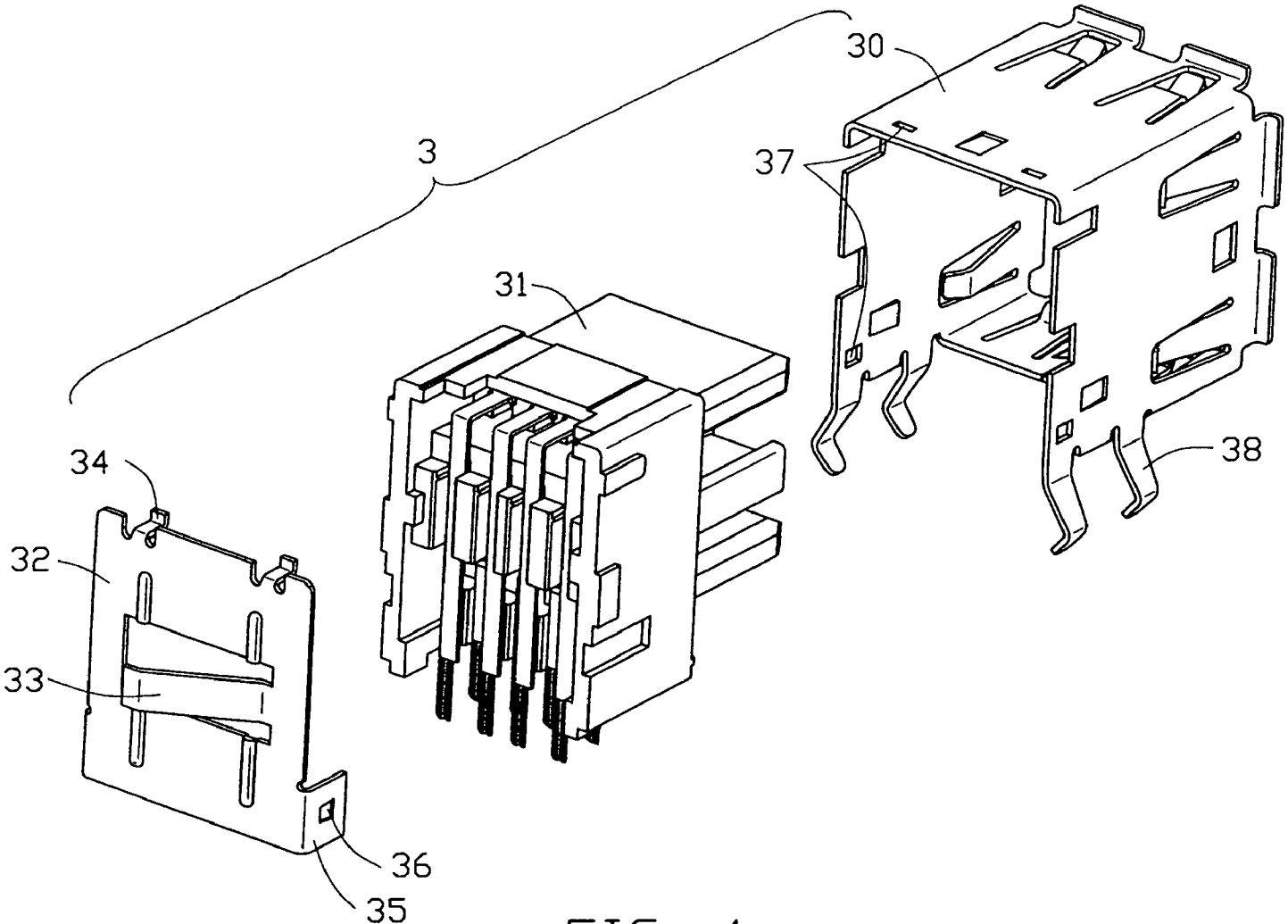
FIG. 4 is a partially exploded view of the electrical connector.

Referring to FIG. 4, the stacked USB connector 3 includes a dielectric body 31 and a metal frame (not labeled) for shielding the body 31. The metal frame consists of a sleeve-shaped first frame 30 and a second frame 32 hooking with the sleeve frame 30. The sleeve frame 30 includes a number of feet 38 for electrically connecting with the printed circuit board downwardly projecting from opposite sides of a bottom wall thereof, thereby effectively eliminating noise received by the first and second frames 30, 32. The second frame 32 is mounted on a rear wall of the dielectric body 31 and includes a grounding finger 33 rearward projecting from a middle portion thereof. The resilient grounding finger 33 is of substantially piece and connects with the daughter circuit board 5, thereby effectively decreasing noise received by the stacked USB connector 3. In addition, the noise received by the daughter circuit board 5 can be leaded by the grounding finger 33 to the printed circuit board, as a result, the daughter circuit board 5 has an excellent grounding function, at the same time, the daughter circuit board 5 need not be assembled additional grounding equipment. The second frame 32 includes a pair of bending portions 34 upwardly extending and bending from a top portion thereof. The second frame 32 includes a pair of wings 35, a pair of depressions 36 respectively inwardly project from corresponding wings 35. The first frame 30 includes a plurality of holes 37 for engaging with the bending portions 34 and the depressions 36 of the second frame 32.

Referring to FIGS. 2–3, the daughter circuit board 5 includes a conductive nod 50. A magnetic module 51 and the transformer module 6 for filtering extraneous noise received by the contact module 2 and the stacked USB connector 3 are mounted on the daughter circuit board 5.

The transformer module 6 includes a base portion 62 and a plurality of connecting terminals 61 fixed in the base portion 62.

The outer shell 7 for shielding the insulative housing 1 consists of a front shell 70 and a rear shell 71. The front and rear shell 70, 71 respectively form a plurality of hook portion (not labeled), thereby securely holding each other. The front shell 70 includes a plurality of legs 72 for connecting with the printed circuit board downwardly extending from the opposite sides of a bottom portion thereof.

Referring to FIGS. 1–5, in assembly, firstly, the LEDs 4 are inserted into the grooves 18 of the insulative housing 1. The soldering portions 24 of the conductive terminals 22 of the contact module 2 are soldered to corresponding circuit traces (not shown) positioned in an upper portion of the daughter circuit board 5. The connecting terminals 61 of the transformer module 6 are soldered to corresponding circuit traces (not shown) positioned in a lower portion of the daughter circuit board 5. Secondly, the contact module 2 soldered on the daughter circuit board 5 is mounted into the upper space 10 of the insulative housing 1, the horizontal portion 20 of the contact module 2 is fixed in the slots 15 of the projecting portion 14. Thirdly, the bending portions 34 and the depressions 36 of the second frame 32 of the stacked USB 3 are latched into corresponding holes 37 of the first frame 30, thereby securely shielding the insulative housing 1. The stacked USB connector 3 is inserted into the lower space 11 of the insulative housing 1. The grounding finger 33 of the second frame 32 projects beyond the through hole 17 of the insulative housing 1 and electrically connects with the conductive nod 50 of the daughter circuit board 5. Therefore, the grounding finger 33 can lead the extraneous noise received by the daughter circuit board to the printed circuit board. Finally, the front and second shell 60, 61 are securely held each other, thereby shielding the insulative housing 1 therein. The rear shell 61 abuts against the tail portion 19 of the insulative housing 1. Finally, the electrical connector assembly 100 is mounted on the printed circuit board, thereby forming an electrical connection between the electrical connector assembly 100 and the printed circuit board.

Comparing with prior arts, the electrical connector assembly 100 according to the present invention adopts a grounding finger 33 integrally formed with the second frame 32 of the stacked USB 3, thereby simplifying the structure of the electrical connector assembly and decreasing the cost of the electrical connector.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

an insulative housing defining a first space and a second space;

a daughter circuit board comprising a plurality of circuit traces;

a contact module received in the first space and comprising a plurality of conductive terminals for connecting to the circuit traces of the daughter circuit board; and a stacked connector received in the second space and comprising a dielectric body and a metal frame for shielding the body, the metal frame comprising a grounding finger to electrically connect with the daughter circuit board.

2. The electrical connector assembly according to claim 1, wherein the metal frame includes a first frame and a second frame, the grounding finger being positioned in the second frame.

3. The electrical connector assembly according to claim 2, wherein the first frame includes a recess and the second frame includes a hook portion for latching into the recess.

4. The electrical connector assembly according to claim 1, wherein the insulative housing comprises a horizontal partition for dividing the first and second spaces and a clapboard perpendicular to the horizontal partition and adjacent to the second frame, and wherein the clapboard comprises a through hole through which the grounding finger electrically connects with the daughter circuit board.

5. The electrical connector assembly according to claim 4, wherein the insulative housing includes a tail portion extending from a rear portion of a top wall thereof.

6. The electrical connector assembly according to claim 1, wherein the daughter circuit board includes a magnetic module positioned thereon for filtering extraneous noise received by the daughter circuit board.

7. The electrical connector assembly according to claim 1, further including a transform module comprising a plurality of connecting terminals electrically connecting with the daughter circuit board.

8. An electrical connector assembly comprising:

an insulative housing defining a first space and a second space in communication with an exterior in a front-to-back direction;

a daughter circuit board comprising a plurality of circuit traces and located behind the first and second spaces in a perpendicular relation with the front-to-back direction;

a plurality of conductive terminals disposed in the first space connecting to the circuit traces of the daughter circuit board; and a connector subassembly received in the second space and including a dielectric body enclosed by a metal frame for shielding; wherein the metal frame comprises a grounding finger extending rearwardly to electrically contact the daughter circuit board.

9. The assembly as claimed in claim 8, wherein said grounding finger extends from a vertical plate of said metal frame.

10. The assembly as claimed in claim 8, wherein said connector subassembly is essentially a dual-port connector, and said grounding finger is located on a middle position of the body.

11. The assembly as claimed in claim 8, wherein said terminals are integrated within a terminal module which is received in the first space.

12. The assembly as claimed in claim 8, wherein said first space is stacked upon the second space.

13. An electrical connector assembly comprising:

a dual-port Universal Serial Bus (USB) connector and an internal circuit board vertically positioned behind the USB connector, said USB connector including:

an insulative body defining stacked Universal Serial Bus ports therein;

a plurality of contacts disposed in the body with tails downwardly extending beyond an undersurface of the body soldering to an external circuit board on which the USB connector is seated;

a metallic frame enclosing said insulative body;

said frame defining feet around a bottom edge for mounting to the external circuit board, and a rearwardly extending grounding fingers electrically and mechanically engaged with said internal circuit board; wherein said external circuit board and said internal circuit board are perpendicular to each other.

14. The assembly as claimed in claim 13, wherein said grounding finger extends from a vertical plate of said frame.

15. The assembly as claimed in claim 14, wherein said grounding finger extends from a rear vertical plate of the frame.

* * * * *